United States Patent [19]

White et al.

[11] Patent Number: 4,738,189

[45] Date of Patent: Apr. 19, 1988

[54] PNEUMATICALLY OPERATED FIRE DAMPER

[75] Inventors: Richard D. White; Robert M. Van Becelaere, both of Prairie Village, Kans.

[73] Assignee: Philips Industrial Components, Inc., Dayton, Ohio

[21] Appl. No.: 887,819

[22] Filed: Jul. 21, 1986

[51] Int. Cl.[4] ..... F24F 11/04

[52] U.S. Cl. ..... 98/42.12; 98/42.16; 98/86; 169/61; 137/77

[58] Field of Search ..... 98/1, 42.12, 42.16, 98/86; 236/49; 137/75, 77, 72; 91/418; 169/60, 61

[56] References Cited

U.S. PATENT DOCUMENTS 4,397,223 8/1983 Maxson ..... 137/75

4,432,272 2/1984 Becelaere ..... 98/1

*Primary Examiner*—Larry I. Schwartz

*Attorney, Agent, or Firm*—Kokjer, Kircher, Bradley, Wharton, Bowman & Johnson

[57] ABSTRACT

A fire damper operated by an air motor for incorporating into the pneumatic piping system of a building. The damper motor holds the damper open under the influence of pressurized air from the system. A valve actuator in the flow channel of the damper has a fusible link maintaining the actuator in a standby condition. Temperature sufficient to destroy the integrity of the link permits an abutment on the actuator to swing to a position allowing the valve member to shift to interrupt the air pressure applied to the motor. This closes the damper. The damper may also be closed independently of operation of the actuator by interrupting the flow of pressurized air to the motor.

7 Claims, 2 Drawing Sheets

PNEUMATICALLY OPERATED FIRE DAMPER

This invention relates to building protective equipment and more particularly to dampers for protecting building passageways such as heating and air conditioning ducts and the like in the event of a fire in the building. Most building codes require that protective devices such as dampers be installed at certain locations in the building duct work. These devices are strategically positioned for isolating portions of the building when a fire occurs. These protective devices automatically operate in the presence of temperatures elevated to a predetermined level to close off the associated passageways.

Conventional fire dampers have long been used for this purpose and usually comprise one or more shutters mounted in a frame and biased toward a closed position by gravity or some type of spring. The shutters are held open by a fusible link to permit the flow of fluid such as heated or refrigerated air through the passageway. The link is typically a two component element secured together by an eutectic solder. The solder melts at the predetermined temperature allowing the components to separate and the damper to close.

Studies of the effects of fires in buildings have revealed that a substantial amount of damage and many fire related fatalities are caused by smoke and toxic fumes generated by fires. Often these consequences are greater than the destruction caused by the heat and direct flames of the fire itself. This has led to a requirement that fire dampers be capable of being closed from a remote control location to block the flow of smoke and fumes through the building as may be required. Often it is desirable that certain dampers be closed to isolate building sections even though the temperatures in the vicinity of such dampers may not have been elevated to a point sufficient to melt the solder of the fusible link which would result in automatic closing of the damper.

Dampers held in the open condition by electric motors have been developed to meet this requirement. The motors of such dampers are conventionally powered from the electrical system of the building. A fusible link or a temperature activated switch may be employed to automatically cause the damper to close in case of elevated temperature caused by a fire at the damper location. The motor can, however, also be operated to close the corresponding passageway by switching off electrical energy to the damper motor. An example of such a fire damper which has met with general commercial success is that shown and described in U.S. Pat. No. 4,432,272.

One disadvantage with electrical motor operated fire dampers is that the building wiring system is often damaged during a fire. Damage of this type may result from the fire itself, from operations carried out to extinguish the fire, or from other causes such as the disabling of the electrical circuitry as may be thought necessary in an emergency for the safety of personnel. Under such conditions the dampers which are affected become closed and the passageways needed for venting smoke and fumes from the building cannot be used for this purpose.

In addition to an electrical system, most buildings are equipped with a pneumatic system. Temperature sensing throughout the building is often accomplished by means of thermostats coupled into the electrical system. However, operation of the control devices which regulate the flow of air throughout the building is carried out by air motors operated by a pneumatic system.

The building's pneumatic system is usually of more rugged construction than the electrical system. Typically, the pneumatic system consists of hard piping extending throughout the building capable of carrying pressurized air and not so likely to be damaged from fire related causes as is the electrical system. Thus, the building's pneumatic system presents a potential for providing a more reliable means for operating fire dampers in emergency situations than the electrical system heretofore utilized for this purpose. Any increase in reliability of operation of protective devices of this kind in the event of emergency is extremely desirable and may translate into the savings of lives and the protection of valuable property.

It is, therefore, a primary object of this invention to provide a motor actuated fire damper which may be operated by a building's pneumatic system.

Another important object of the present invention is to provide a pneumatically operated fire damper which is constructed in a manner to meet existing codes and relevant independent testing laboratory standards for protective devices of this type.

In the carrying out of the foregoing object, it is a further object of the present invention to provide a pneumatically operated fire damper which is capable of automatic operation to protect a passageway in case of elevated temperature at the damper location, yet which may be readily operated from remote locations by the building's pneumatic system even in the absence of such temperature elevation at the damper location.

A still further important object of this invention is the provision of a unique actuator for automatically closing the damper upon the melting of a fusible link by ambient temperature while the damper motor is coupled with the building's pneumatic system.

These and other important aims and objectives of the invention will be further explained or will become apparent from the following description and explanation of the drawings, wherein.

Figure 1:
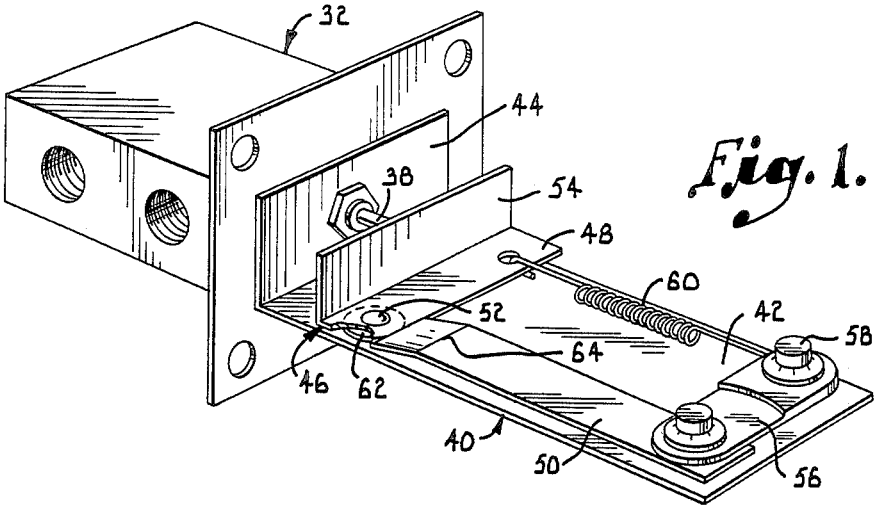
FIG. 1 is a perspective view on a reduced scale of a pneumatic valve and actuator assembly constructed pursuant to the principles of this invention.

A fire damper embodying the principles of this invention is broadly designated in the drawings by the reference numeral 10. Damper 10 conventionally comprises a peripherally extending frame 12 constructed of rigid material such as steel or the like. One or more blades 14 may be pivotally mounted on frame 12 by horizontally extending blade axles 16. The axles 16 are conventionally interconnected by mechanism (not shown) and the blades are fixed to their respective axles so that all blades rotate in unison in a common direction between the closed position blocking flow through the damper as illustrated in FIG. 4 of the drawing and an open position permitting flow through the damper as illustrated in FIG. 3 of the drawing.

Figure 4:
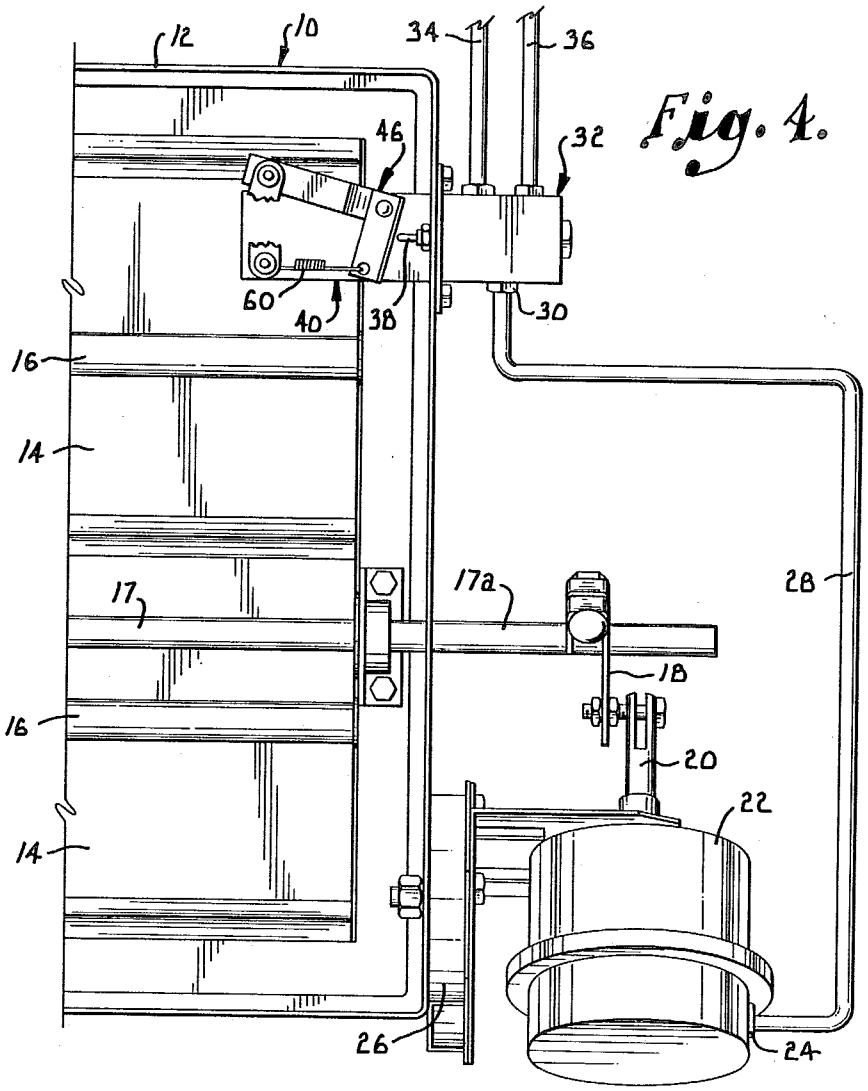
FIG. 4 is a view similar to FIG. 3 but showing the damper in its closed condition with the fusible link components separated as a result of exposure to elevated temperature.
Figure 3:
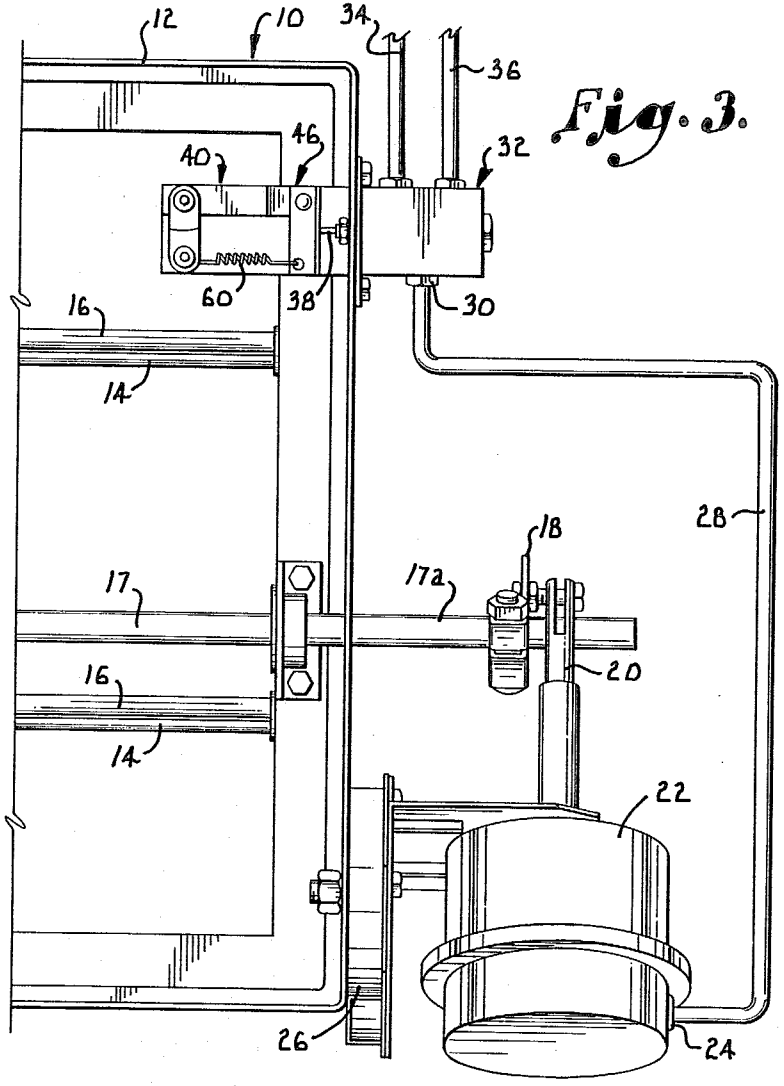
FIG. 3 is a fragmentary front elevational view of the damper of FIG. 2.

A horizontally disposed shaft 17 is rotatably mounted to frame 12 and has an integral extension 17*a* projecting laterally exteriorally of the frame 12 as illustrated best in FIGS. 3 and 4. A crank arm 18 is bolted to extension 17*a* and serves to pivotally couple the plunger 20 of a pneumatic motor 22 to the axle extension in the manner shown. Shaft 17 is coupled to an axle 16 by mechanism (not shown) so that rotation of the shaft causes corresponding rotation of the axles 16 and their respective blades 14.

Motor 22 is a commercially available, single action air motor of the type having an internal spring normally biasing the plunger to its retracted position as shown in FIG. 4. Application of pressurized air to the motor inlet port 24 extends the motor plunger to the position illustrated in FIG. 3 of the drawing. Release of the pressure to the motor permits the latter to automatically return under the influence of its internal spring to the plunger retracted position.

Motor 22 is preferably mounted to frame 12 by a mounting element 26 which is bolted to the motor and to the frame respectively. A conduit 28 interconnects the motor port 24 with the outlet port 30 of a pneumatic valve 32 also preferably mounted to the exterior of frame 12. Pressurized air is conducted to valve 32 through a conduit 34 from a source (not shown). A return line 36 vents valve 32 to atmosphere. The conduits 34 and 36 normally comprise a portion of the pneumatic system of the building into which the damper is to be installed.

Valve 32 is of a type readily available commercially and includes an internal valve member having a projection 38 extending outwardly from the valve body for shifting the valve member as may be desired. The valve member is biased by an internal spring tending to shift the valve member to the left as viewed in FIG. 4 of the drawing wherein the internal ports of the valve member interconnect conduit 28 with the exhaust or return line 36. When valve member 38 is shifted to the right to the position shown in FIG. 3 of the drawing, the internal ports of the valve member interrupt the communication of conduit 28 with line 36 and establish communication between conduit 34 and conduit 28.

An actuator for valve 32 is broadly designated by the reference numeral 40 and includes a base in the form of an elongated, rigid, generally L-shaped plate 42 having a flange 44 secured to valve 32 as illustrated in FIG. 1. A crank 46 having one leg 48 extending transversely across plate 42 and a second leg 50 integral with leg 48 and extending generally at a right angle therefrom is pivotally mounted by a pin 52 to the upper surface of plate 42 as shown. Crank leg 48 has an integral, outwardly extending flange 54 disposed to engage the projecting end of valve member 38 to hold the valve member in the position intercommunicating conduits 34 and 28 when the components of the actuator are in the positions shown in FIGS. 1 and 3 of the drawing.

The actuator components are maintained in the relative positions illustrated best in FIG. 1 against the bias of the internal valve spring urging valve member 38 outwardly from the valve housing, by means of a fusible link 56 having one end attached to crank leg 50 in spaced relationship from pivot pin 52 and the other end of the fusible link attached to a post 58 secured to plate 42. Link 56 is of the type conventionally employed for fire dampers and other protective devices of this type. Accordingly, link 56 typically includes two components soldered together by eutectic solder which has the characteristic of melting rather rapidly to destroy the physical integrity of the link when the temperature reaches a predetermined value. Link 56 is of entirely conventional construction, is well known to those skilled in the art and need not be described in greater detail.

The tendency for crank 46 to swing in a clockwise direction about pin 52 as viewed in FIG. 1 is enhanced by spring means interposed between the crank and its mounting plate. Thus, one end of an elongated coil spring 60 is attached to crank leg 48 in spaced apart relationship from pivot 52. The other end of spring 60 is attached to post 58. Clearance for accommodating the hooked end of spring 60 and the attachment of link 56 to arm 50 to insure that crank 46 can freely pivot on the plate unless restrained by link 56 is provided by a washer 62 interposed between the crank and the plate at pivot 52. Further, leg 50 is preferably provided with a bend 64 slightly elevating the major portion of the leg away from physical engagement with the surface of plate 42.

Figure 2:
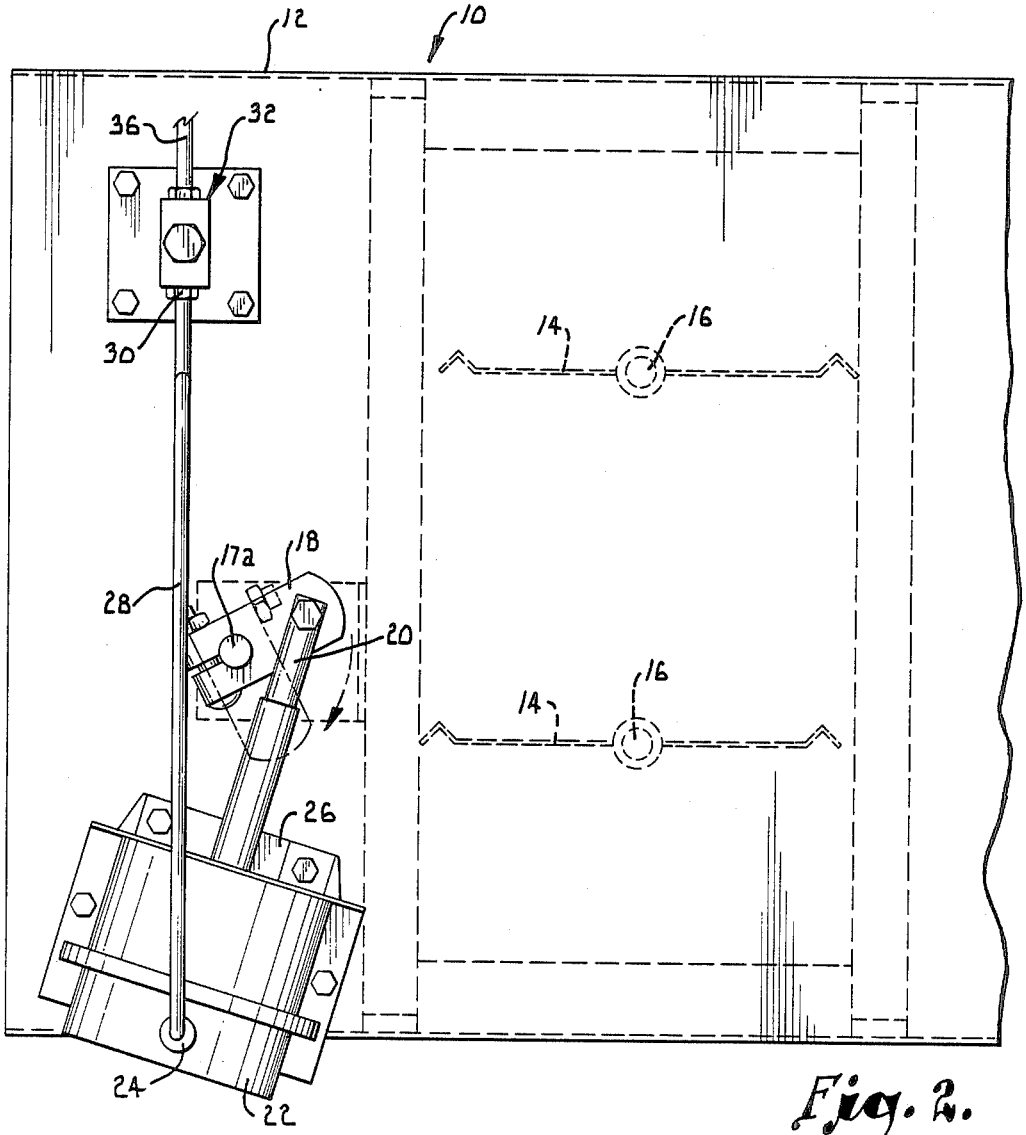
FIG. 2 is a side elevational view of a damper of this invention in its open condition, the positions of the damper blades being shown in broken lines and the duct protected by the damper also being shown fragmentarily in broken lines.

Actuator 40 is preferably mounted in conjunction with valve 32 so that the actuator projects into the path of fluid flowing through the damper as illustrated in FIGS. 3 and 4 of the drawing. Damper 10 is, of course, interposed in a building passageway such as heating or air conditioning duct so that fluid flowing through the duct passes through the damper. Valve member 38 is, of course, held in the position wherein the pressurized air flowing from conduit 34 through conduit 28 to the motor causes the extension of plunger 20 to rotate the blades to the open position illustrated in FIGS. 2 and 3 of the drawing. This is the normal standby condition of the damper.

In the event that the ambient temperature should become elevated to a predetermined value, as might result from a fire, the structural integrity of link 56 is destroyed. This releases arm 50, permitting crank 46 to pivot about pin 52 under the influence of spring 60. Such pivoting of crank 46 swings flange 54 away from its blocking position against valve member 38, permitting the internal valve spring to shift the valve member. Such shifting of valve member 38 shuts off the flow of pressurized fluid through conduit 34 and communicates conduit 28 with atmosphere through line 36. This, in turn, releases the pressure applied to motor 22 permitting the plunger of the motor to be withdrawn under the influence of the motor internal spring heretofore described.

When plunger 20 retracts, it swings arm 18 to rotate shaft 17*a* in a direction to close the damper blades. This blocks the flow of fluid through the duct protected by the damper.

In the event of a fire in the building at a location sufficiently remote from damper 10 that the heat fails to destroy the integrity of the fusible link, the damper can be closed from a remote location. Such closure might be highly desirable to protect against the flow of smoke and toxic fumes through the building duct work. All that is required to close the damper is to release the pressurized fluid in line 34.

It will be recognized by those skilled in this art that a fluid other than air might be utilized to operate the damper of this invention. Any fluid under pressure could be used for this purpose without departing from the spirit of this invention. The damper has been described in connection with a pneumatic system because buildings typically are equipped with a pneumatic system which can readily be utilized to operate dampers embodying the principles herein disclosed. The terms "air" and "pneumatic" have been used for descriptive convenience only, and should be understood as including other fluids useful for operating the damper motor.

Having thus described the invention, I claim:

1. A fire damper operable by a pneumatic system comprising:

a peripherally extending frame defining a fluid passage therethrough;

blade means mounted on the frame for movement between an open position permitting fluid flow through the damper and a closed position blocking said fluid flow;

pneumatic motor means adapted to be coupled with a source of pressurized air and operably coupled with the blade means for normally holding the blade means in the closed position and for moving the blade means to the open position when pressurized air is applied to the motor means; and thermal responsive valve means interposed between motor means and the source of pressurized air for blocking the flow of pressurized air to the motor means to close the blade means when the ambient temperature reaches a predetermined value, said thermal responsive valve means including a valve adapted to be coupled with said source of pressurized air and a valve member normally in a flow blocking position and shiftable to an open position; and a thermal responsive actuator operably associated with the valve member normally holding the latter in said open position when the temperature reaches a predetermined value to permit the valve member to shift to its flow blocking position, said actuator including a base, and an elongated, rigid element pivotally mounted to the base to present an abutment normally engaged against the valve member to hold the latter in its open position, said element being swingable about its point of pivotal attachment to the base away from said engaged position to permit the valve member to shift to its flow blocking position when the temperature reaches said predetermined value.

2. A fire damper as set forth in claim 1, wherein said element is a rigid crank having one arm disposed to engage the valve member for holding the latter in its open position, the other arm of the crank being secured to the base to prevent pivoting of the crank by a fusible link, and spring means connected with the crank and the base for biasing the crank to rotate in a direction to move said one arm away from the valve member to permit said shifting of the latter upon destruction of the integrity of the fusible link when the temperature reaches said predetermined value.

3. A fire damper as set forth in claim 2, wherein said base includes an elongated, rigid plate secured to the damper frame and projecting inwardly into the path of fluid flow through the damper, whereby to actuate said pneumatic valve and close the damper when the temperature of fluid flowing through the damper reaches said predetermined value.

4. An actuator for operating a valve member of a pneumatic valve controlling a supply of pressurized air to a pneumatic motor operating a fire damper, said actuator comprising:

an elongated, rigid base adapted to be secured to the damper in disposition extending into the flow of fluid through the damper;

a crank having a pair of arms, said crank being pivotally mounted on the base, one arm of the crank being adapted to engage said valve member to hold the latter in a first position;

a fusible link secured to the other crank arm and to the base respectively to hold the crank in a fixed position; and spring means secured to the base and to the crank biasing the latter to pivot in a direction to move said one crank arm away from its valve member blocking position, whereby exposure of the actuator to a temperature of predetermined value destroys the integrity of the fusible link permitting pivoting of the crank and shifting of the valve member from said first position.

5. An actuator as set forth in claim 4, wherein said one crank arm includes a flange in disposition for engaging the valve member.

6. An actuator as set forth in claim 5, wherein said spring means includes an elongated coil spring, there being a post mounted on the base and projecting therefrom, one end of the spring being attached to said one rank arm in spaced relationship from the pivot point of the crank, the other end of the spring being attached to the post.

7. An actuator as set forth in claim 6, wherein one end of the fusible link is attached to the other crank arm in spaced relationship from the pivot point of the crank, the other end of the link being attached to the post.

* * * * *